US005604188A

United States Patent [19]

Ryan

[11] Patent Number: 5,604,188

[45] Date of Patent: Feb. 18, 1997

[54] ZINC ADDITIVES OF ENHANCED PERFORMANCE CAPABILITIES

[75] Inventor: Helen T. Ryan, London, England

[73] Assignee: Ethyl Petroleum Additives Limited, Bracknell, England

[21] Appl. No.: 529,937

[22] Filed: Sep. 18, 1995

[30] Foreign Application Priority Data

Sep. 26, 1994 [GB] United Kingdom ..... 9419333

[51] Int. Cl.[6] ..... C10M 141/00; C10M 141/12

[52] U.S. Cl. ..... 508/371; 508/378

[58] Field of Search ..... 252/32.7 E

[56] References Cited

U.S. PATENT DOCUMENTS

| | | | |
|---|---|---|---|
| 3,726,798 | 4/1973 | Silver et al. | 252/32.7 E |
| 4,308,154 | 12/1981 | Clason et al. | 252/32.7 E |
| 4,417,990 | 11/1983 | Clason et al. | 252/32.7 E |
| 4,466,894 | 8/1984 | Grover | 252/32.7 E |
| 4,528,108 | 7/1985 | Grover | 252/32.7 E |
| 4,592,851 | 6/1986 | Stadtmiller et al. | 252/32.7 E |
| 5,152,908 | 10/1992 | Tipton | 252/32.7 E |
| 5,326,485 | 7/1994 | Cervenka et al. | 252/32.7 E |
| 5,415,793 | 5/1995 | Nassry et al. | 252/32.7 E |

*Primary Examiner*—Ellen M. McAvoy
*Attorney, Agent, or Firm*—Dennis H. Rainear

[57] ABSTRACT

Novel zinc additives are provided which function as anti-oxidants and extreme pressure agents for lubricants and possess high thermal stability. In addition, they exhibit good filterability performance and good corrosion resistance. The zinc-containing additives are formed by admixing (i) at least one zinc dialkyldithiophosphate wherein each alkyl group contains 6 to 12 carbon atoms and is branched on its beta-carbon atom, and (ii) at least one zinc alkanoate wherein each alkanoate group is branched on its beta-carbon atom, in a ratio of 6.0 to 8.0 equivalents of (i) per equivalent of (ii).

19 Claims, No Drawings

ZINC ADDITIVES OF ENHANCED PERFORMANCE CAPABILITIES

This invention fulfills a need for new zinc additives having a combination of enhanced performance capabilities rendering them particularly useful as additives for lubricating oil compositions (i.e., lubricants and functional fluids), and especially as additives for oil-based hydraulic fluids.

U.K. Patent GB 2 053 920 B describes certain mixed metal salts for use in lubricants and functional fluids, especially hydraulic fluids. Such salts are defined as a metal salt of (A) at least one acid of the formula $$(R^1O)(R^2O)PSSH$$

wherein each of $R^1$ and $R^2$ is a hydrocarbon-based radical, and a metal salt of (B) at least one aliphatic or alicyclic carboxylic acid having the formula $R^3COOH$ which contains from 5 to 20 carbon atoms and wherein $R^3$ is an hydrocarbon-based radical; the ratio of equivalents of A to B being between 2.5:1 and 4.5:1, up to 2 equivalents of metal being at least one Group I metals, Group II metals, aluminum, tin, cobalt, lead, molybdenum, manganese and nickel. In a preferred embodiment of the patent, $R^1$ and $R^2$ are 2-ethylhexyl and $R^3$ is 3-heptyl. The salts of the patent are indicated to function as antioxidants and extreme pressure agents and to possess higher thermal stability than had previously been the case. The patent also states that it is desirable to incorporate relatively large amounts of metal in such compositions.

In accordance with the present invention, certain zinc salts are provided which function as antioxidants and extreme pressure agents and possess high thermal stability, and in addition, exhibit good filterability performance (e.g., in the AFNOR wet filterability test) and good corrosion resistance. And in the achievement of these highly beneficial results, it is not necessary to incorporate relatively large amounts of metal in such compositions. Thus in addition to providing a balanced combination of enhanced performance capabilities, this invention makes available important benefits from the environmental and conservational standpoints as well.

Pursuant to this invention these advantages are achieved by the provision of a zinc-containing additive formed by admixing (i) at least one zinc dialkyldithiophosphate wherein each alkyl group contains 6 to 12 carbon atoms and is branched on its beta-carbon atom, and (ii) at least one zinc alkanoate wherein each alkanoate group is branched on its beta-carbon atom, in a ratio of 6.0 to 8.0 equivalents of (i) per equivalent of (ii). Preferred additives of this type have a total base number (TBN) of at least 10 milligrams of KOH per gram. TBN can be determined using the ASTM D664 procedure. In another preferred embodiment, each alkyl group of (i) has the same number of carbon atoms as each alkanoate group of (ii). In a particularly preferred embodiment, (i) is zinc di(2-ethylhexyl)dithiophosphate and (ii) is zinc 2-ethylhexanoate.

As used herein, one equivalent of zinc dialkyldithiophosphate is 0.5 mole thereof and one equivalent of zinc carboxylate is 0.167 moles thereof.

While mixing can be effected at any suitable temperature, it is desirable to conduct the mixing at a temperature in the range of 20° C. to 90° C.

Without desiring to be bound by theoretical considerations, it is believed, on the basis of $^{31}P$ nmr studies, that when (i) and (ii) are brought together in the proportions and under the conditions specified above, a change in composition occurs (perhaps through chemical reaction) whereby the resulting composition attains a higher basicity as reflected by an increase in TBN as compared to the TBN of the initial component (i).

The additives of this invention preferably further comprise one or more inert diluents, preferably one or more mineral oil diluents. Amounts of diluent will typically be in the range of 1 to 20 wt %, and preferably in the range of 5 to 15 wt % based on the total weight of (i), (ii) and diluent.

The above additive compositions of this invention can be utilized in forming lubricating oil compositions using the same kind of base oils and the same kind of other additive components as are referred to in UK Patent GB 2 053 920 B, or in either of the related U.S. Pat. Nos. 4,308,154 and 4,417,990. Indeed, it is contemplated that the above zinc-containing additive compositions of this invention can be utilized as total or partial replacements of conventional zinc dialkyldithiophosphates in any lubricating oil compositions, whether lubricants or functional fluids, in which conventional zinc dialkyldithiophosphates are normally employed, provided that the particular components used in formulating the conventional composition are compatible with the zinc-containing additive composition of this invention.

A further embodiment of this invention is a lubricating oil composition which comprises at least 50% by weight of oil of lubricating viscosity and from 0.02 to 0.1 wt % of phosphorus (and preferably from 0.025 to 0.05 wt % of phosphorus) as a zinc-containing additive formed by admixing (i) at least one zinc dialkyldithiophosphate wherein each alkyl group contains 6 to 12 carbon atoms and is branched on its beta-carbon atom, and (ii) at least one zinc alkanoate wherein each alkanoate group is branched on its beta-carbon atom, in a ratio of 6.0 to 8.0 equivalents of (i) per equivalent of (ii). As noted above, a preferred additive of this type will itself have a TBN (per ASTM D664) of at least 10 milligrams of KOH per gram. It is also preferred that each alkyl group of (i) have the same number of carbon atoms as each alkanoate group of (ii). In a particularly preferred embodiment, (i) is zinc di(2-ethylhexyl)dithiophosphate and (ii) is zinc 2-ethylhexanoate.

Still another embodiment of this invention is a lubricating oil additive concentrate (sometimes referred to as an additive package) formulated for addition to oil-based hydraulic fluid which comprises 1 to 50 wt% (and preferably 5 to 30 wt %) of at least one liquid inert diluent, preferably one or more light mineral oils such as 90 to 150 solvent neutral oils, and from 1 to 10 wt % of phosphorus (and preferably from 2 to 5 wt % of phosphorus) as a zinc-containing additive formed by admixing (i) at least one zinc dialkyldithiophosphate wherein each alkyl group contains 6 to 12 carbon atoms and is branched on its beta-carbon atom, and (ii) at least one zinc alkanoate wherein each alkanoate group is branched on its beta-carbon atom, in a ratio of 6.0 to 8.0 equivalents of (i) per equivalent of (ii). Once again, the preferred zinc-containing additive itself will have a TBN (per ASTM D664) of at least 10 milligrams of KOH per gram. Preferably each alkyl group of (i) has the same number of carbon atoms as each alkanoate group of (ii). In a particularly preferred embodiment, (i) is zinc di(2-ethylhexyl)dithiophosphate and (ii) is zinc 2-ethylhexanoate.

Other preferred embodiments of the invention are lubricating oil compositions or additive concentrates containing or comprising a) at least one zinc-containing additive composition of this invention formed from (i) and (ii) as described above, and b) an oil-soluble ashless dispersant, preferably but not necessarily, a carboxylic derivative ashless dispersant. In general, these components are utilized in proportions by weight on an active ingredient basis such that per part of a) there are from 0.002 to 5 parts by weight of b), and preferably, from 0.0045 to 2.5 parts by weight of b). When these components are used in formulating power transmission fluids, especially hydraulic fluids, the proportions of a) and b) are preferably as described hereinafter.

Still another preferred embodiment of this invention is an additive composition which comprises an additive concentrate formulated from the following oil-soluble components:

a) a zinc-containing additive formed by admixing (i) at least one zinc dialkyldithiophosphate wherein each alkyl group contains 6 to 12 carbon atoms and is branched on its beta-carbon atom, and (ii) at least one zinc alkanoate wherein each alkanoate group is branched on its beta-carbon atom, in a ratio of 6.0 to 8.0 equivalents of (i) per equivalent of (ii);

b) at least one carboxylic derivative ashless dispersant;

c) at least one antioxidant;

d) at least one sulfurized fatty ester having a sulfur content in the range of 7 to 12 wt % (preferably in the range of 7 to 10 wt %, and most preferably about 9 wt %);

e) at least one rust inhibitor; and f) at least one demusifier: and g) optionally, but preferably, at least one diluent such as a light mineral oil diluent.

A further preferred embodiment of this invention is lubricating oil composition especially adapted for use as a power transmission fluid, and more particularly as a hydraulic fluid, which comprises a major amount of oil of lubricating viscosity and minor amounts of components a), b), c), d), e), and f) as specified above.

For best results, the foregoing compositions containing components a) through f), and optionally g), should be devoid of boron and of any metal other than zinc. While the proportions can be varied to whatever extent is deemed necessary or desirable in any given situation, typically components a) through f) are employed in proportions by weight on an active ingredient basis such that per part of a) there are from 0.002 to 0.05 part of b), from 0.2 to 1 part of c), from 0.03 to 0.3 part of d), from 0.02 to 0.2 part of e), and from 0.002 to 0.3 part of f). Preferably, components a) through f) are employed in proportions by weight on an active ingredient basis such that per part of a) there are from 0.0045 to 0.01 part of b) , from 0.4 to 0.6 part of c), from 0.07 to 0.17 part of d), from 0.07 to 0.12 part of e) , and from 0.0045 to 0.2 part of f) . By "active ingredient basis" is meant that the weight of any solvent or diluent that may be associated with a given component as received is eliminated from consideration when calculating the weight proportions. In the additive concentrates wherein component g) is used, the overall composition should not contain more than 80 wt % of such diluent. The finished lubricant compositions of this invention will generally contain from 0.02 to 0.1 wt %, and preferably from 0.025 to 0.05 wt % of phosphorus as the zinc-containing additive compositions of this invention, and when one or more of components b) through f) are utilized therewith, they are preferably proportioned to component a) in the ranges set forth above.

In each and every one of the embodiments of the invention described above, the ratio of (i) to (ii) in the zinc additive is preferably in the range of 6.5 to 7.2 equivalents of (i) per equivalent of (ii), and most preferably in the range of 6.9 to 7.1 equivalents of (i) per equivalent of (ii). Also, the TBN of the zinc additive of this invention is preferably at least 10 milligrams of KOH per gram using the ASTM D664 procedure.

Presented below are illustrations of typical materials which can be selected for use as components a) through g) above.

Component a)

Typical zinc dialkyldithiophosphates wherein each alkyl group contains 6 to 12 carbon atoms and is branched on its beta-carbon atom used in forming component a) include zinc di (2 -methylpentyl) dithiophosphate, zinc di (2 -ethylbutyl) dithiophosphate, zinc di (2-methylhexyl) dithiophosphate, zinc di (2-ethylpentyl) dithiophosphate, zinc di (2,2-dimethylpentyl) dithiophosphate, zinc di (2-methylheptyl) dithiophosphate, zinc di (2-ethylhexyl)dithiophosphate, zinc di (2,4-dimethylhexyl) dithiophosphate, zinc di (2-methyloctyl) dithiophosphate, zinc di(2,5-dimethylheptyl)dithiophosphate, and similar beta-branched homologs and analogs having up to 12 carbon atoms in each alkyl group. Mixtures of two or more zinc dialkyldithiophosphates in which each alkyl group contains 6 to 12 carbon atoms and is branched on its beta-carbon atom can also be used. Less than about 10 mole % of the entire zinc dialkyldithiophosphate used in forming component a) may be in the form of oil-soluble zinc dihydrocarbyldithiophosphates which do not contain 6 to 12 carbon atoms and/or which are not branched on the beta-carbon atom (and which thus do not meet the foregoing structural criteria). However it is preferable to use a zinc dihydrocarbyldithiophosphates all of which meets the foregoing structural criteria.

The zinc alkanoates used in forming component a) are those wherein each alkanoate group is branched on its beta-carbon atom. Examples of such compounds are zinc 2-methylpropionate, zinc 2-methylbutyrate, zinc 2-methylvalerate, zinc 2-ethylbutyrate, zinc 2-methylhexanoate, zinc 2-ethylvalerate, zinc 2-methylheptanoate, zinc 2-ethylhexanoate, and zinc salts of similar beta-branched aliphatic acids having up to about 18–20 carbon atoms per molecule. Preferred zinc alkanoates have 6 to 12 carbon atoms in the alkanoate group. Mixtures of two or more of the zinc alkanoates can also be used. Less than about 10 mole % of the entire zinc alkanoate used in forming component a) may be in the form of zinc alkanoate which is not branched on the beta-carbon atom, such as zinc acetate, zinc propionate, zinc heptanoate, zinc decanoate, zinc hexadecanoate, etc. However the preferred zinc alkanoates are all beta-branched.

As noted above, the zinc dialkyldithiophosphates and the zinc alkanoates are employed in a ratio of 6.0 to 8.0 equivalents of zinc dialkyldithiophosphate per equivalent of zinc alkanoate.

Component b)

Suitable types of ashless dispersants which can be used in accordance with preferred embodiments of this invention include the oil-soluble Mannich base dispersants, the oil-soluble long-chain polyamine dispersants, and most preferably, the carboxylic derivative ashless dispersants, especially succinimide dispersants, succinic ester-amide dispersants, and aminoguanidine products formed by reaction of an alkenyl succinic acylating agent and aminoguanidine or a basic salt thereof.

As is well known, Mannich base dispersants are typically products formed by reaction among one or more polyamines, formaldehyde and a hydrocarbyl phenol in which the hydrocarbyl substituent is a hydrogenated or unhydrogenated polyolefin group and preferably a polypropylene or polyisobutene group having a number average molecular weight (as measured by gel permeation chromatography) of from 250 to 10,000, and more preferably from 500 to 5,000, and most preferably from 750 to 2,500.

Oil-soluble long-chain polyamine dispersants are likewise well known to those skilled in the art. They generally comprise one or more polyamine moieties suitably linked to a long chain polymeric hydrocarbon. Methods for producing such dispersants have been extensively reported in the literature.

As is also well known to those skilled in the art, carboxylic derivative ashless dispersants are reaction products of an acylating agent (e.g., a monocarboxylic acid, dicarboxylic acid, polycarboxylic acid, or derivatives thereof) with one or more polyamines and/or polyhydroxy compounds. These products are described in many patents, including British Patent Specification 1,306,529 and the following U.S. Pat. Nos.: 3,163,603; 3,184,474; 3,215,707; 3,219,666; 3,271,310; 3,272,746; 3,281,357; 3,306,908; 3,311,558; 3,316,177; 3,340,281; 3,341,542; 3,346,493; 3,381,022; 3,399,141; 3,415,750; 3,433,744; 3,444,170; 3,448,048; 3,448,049; 3,451,933; 3,454,607; 3,467,668; 3,522,179; 3,541,012; 3,542,678; 3,574,101; 3,576,743; 3,630,904; 3,632,510; 3,632,511; 3,697,428; 3,725,441; 3,868,330; 3,948,800; 4,234,435; and Re 26,433.

There are a number of sub-categories of carboxylic derivative ashless dispersants. One such sub-category which constitutes a preferred type is composed of the polyamine succinamides and more preferably the polyamine succinimides in which the succinic group contains a hydrocarbyl substituent containing at least 30 carbon atoms. The polyamine used in forming such compounds contains at least one primary amino group capable of forming an imide group on reaction with a hydrocarbon-substituted succinic acid or acid derivative thereof such an anhydride, lower alkyl ester, acid halide, or acid-ester. Representative examples of such dispersants are given in U.S. Pat. Nos. 3,172,892; 3,202,678; 3,216,936; 3,219,666; 3,254,025; 3,272,746; and 4,234,435. The alkenyl succinimides may be formed by conventional methods such as by heating an alkenyl succinic anhydride, acid, acid-ester, acid halide, or lower alkyl ester with a polyamine containing at least one primary amino group. The alkenyl succinic anhydride may be made readily by heating a mixture of olefin and maleic anhydride to about 180°–220° C. The olefin is preferably a polymer or copolymer of a lower monoolefin such as ethylene, propylene, 1-butene, isobutene and the like. The more preferred source of alkenyl group is from polyisobutene having a number average molecular weight of up to 100,000 or higher. In a still more preferred embodiment the alkenyl group is a polyisobutenyl group having a number average molecular weight (determined using the method described in detail hereinafter) of about 500–5,000, and preferably about 700–2,500, more preferably about 700–1,400, and especially 800–1,200. The isobutene used in making the polyisobutene is usually (but not necessarily) a mixture of isobutene and other $C_4$ isomers such as 1-butene. Thus, strictly speaking, the acylating agent formed from maleic anhydride and "polyisobutene" made from such mixtures of isobutene and other $C_4$ isomers such as 1-butene, can be termed a "polybutenyl succinic anhydride" and a succinimide made therewith can be termed a "polybutenyl succinimide". However, it is common to refer to such substances as "polyisobutenyl succinic anhydride" and "polyisobutenyl succinimide", respectively. As used herein "polyisobutenyl" is used to denote the alkenyl moiety whether made from a highly pure isobutene or a more impure mixture of isobutene and other $C_4$ isomers such as 1-butene.

Polyamines which may be employed in forming the ashless dispersant include any that have at least one primary amino group which can react to form an imide group. A few representative examples include branched-chain alkanes containing two or more primary amino groups such as tetraamino-neopentane, etc.; polyaminoalkanols such as 2-(2-aminoethylamino)ethanol and 2-[2-(2-aminoethylamino)-ethylamino]-ethanol; heterocyclic compounds containing two or more amino groups at least one of which is a primary amino group such as 1-(β-aminoethyl)-2-imidazolidone, 2-(2-aminoethylamino)-5-nitropyridine, 3-amino-N-ethylpiperidine, 2-(2-aminoethyl)-pyridine, 5-aminoindole, 3-amino-5-mercapto-1,2,4-triazole, and 4-(aminomethyl)-piperidine; and the alkylene polyamines such as propylene diamine, dipropylene triamine, di-(1,2-butylene)triamine, N-(2-aminoethyl)-1,3-propanediamine, hexamethylenediamine and tetra-(1,2-propylene)pentamine.

The most preferred amines are the ethylene polyamines which can be depicted by the formula $$H_2N(CH_2CH_2NH)_nH$$

wherein n is an integer from one to about ten. These include: ethylene diamine, diethylene triamine, triethylene tetramine, tetraethylene pentamine, pentaethylene hexamine, and the like, including mixtures thereof in which case n is the average value of the mixture. These ethylene polyamines have a primary amine group at each end so can form mono-alkenylsuccinimides and bis-alkenylsuccinimides. Commercially available ethylene polyamine mixtures usually contain minor amounts of branched species and cyclic species such as N-aminoethyl piperazine, N,N'-bis(aminoethyl)piperazine, N,N'-bis(piperazinyl)ethane, and like compounds. The preferred commercial mixtures have approximate overall compositions falling in the range corresponding to diethylene triamine to pentaethylene hexamine, mixtures generally corresponding in overall makeup to tetraethylene pentamine being most preferred. Methods for the production of polyalkylene polyamines are known and reported in the literature. See for example U.S. Pat. No. 4,827,037 and references cited therein.

Thus especially preferred ashless dispersants for use in the present invention are the products of reaction of a polyethylene polyamine, e.g. triethylene tetramine or tetraethylene pentamine, with a hydrocarbon-substituted carboxylic acid or anhydride (or other suitable acid derivative) made by reaction of a polyolefin, preferably polyisobutene, having a number average molecular weight of 500 to 5,000, preferably 700 to 2,500, more preferably 700 to 1,400 and especially 800 to 1,200, with an unsaturated polycarboxylic acid or anhydride, e.g., maleic anhydride, maleic acid, fumaric acid, or the like, including mixtures of two or more such substances.

As used herein the term "succinimide" is meant to encompass the completed reaction product from reaction between the amine reactant(s) and the hydrocarbon-substituted carboxylic acid or anhydride (or like acid derivative) reactant(s), and is intended to encompass compounds wherein the product may have amide, amidine, and/or salt linkages in addition to the imide linkage of the type that results from the reaction of a primary amino group and an anhydride moiety.

Residual unsaturation in the alkenyl group of the alkenyl succinimide may be used as a reaction site, if desired. For example the alkenyl substituent may be hydrogenated to form an alkyl substituent. Similarly the olefinic bond(s) in the alkenyl substituent may be sulfurized, halogenated, hydrohalogenated or the like. Ordinarily, there is little to be gained by use of such techniques, and thus the use of alkenyl succinimides is preferred.

Another sub-category of carboxylic derivative ashless dispersants which can be used in the compositions of this invention includes alkenyl succinic acid esters and diesters of alcohols containing 1–20 carbon atoms and 1–6 hydroxyl groups. Representative examples are described in U.S. Pat. Nos. 3,331,776; 3,381,022; and 3,522,179. The alkenyl succinic portion of these esters corresponds to the alkenyl succinic portion of the succinimides described above including the same preferred and most preferred subgenus, e.g., alkenyl succinic acids and anhydrides, etc., where the alkenyl group contains at least 30 carbon atoms and notably, polyisobutenyl succinic acids and anhydrides wherein the polyisobutenyl group has a number average molecular weight of 500 to 5,000, preferably 700 to 2,500, more preferably 700 to 1,400, and especially 800 to 1,200. As in the case of the succinimides, the alkenyl group can be hydrogenated or subjected to other reactions involving olefinic double bonds.

Alcohols useful in preparing the esters include methanol, ethanol, 2-methylpropanol, octadecanol, eicosanol, ethylene glycol, diethylene glycol, tetraethylene glycol, diethylene glycol monoethylether, propylene glycol, tripropylene glycol, glycerol, sorbitol, 1,1,1-trimethylol ethane, 1,1,1-trimethylol propane, 1,1,1-trimethylol butane, pentaerythritol, dipentaerythritol, and the like.

The succinic esters are readily made by merely heating a mixture of alkenyl succinic acid, anhydrides or lower alkyl (e.g., $C_1$–$C_4$) ester with the alcohol while distilling out water or lower alkanol. In the case of acid-esters less alcohol is used. In fact, acid-esters made from alkenyl succinic anhydrides do not evolve water. In another method the alkenyl succinic acid or anhydrides can be merely reacted with an appropriate alkylene oxide such as ethylene oxide, propylene oxide, and the like, including mixtures thereof.

Still another sub-category of carboxylic derivative ashless dispersants useful in forming compositions of this invention comprises an alkenyl succinic ester-amide mixture. These may be made by heating the above-described alkenyl succinic acids, anhydrides or lower alkyl esters or etc. with an alcohol and an amine either sequentially or in a mixture. The alcohols and amines described above are also useful in this embodiment. Alternatively, amino alcohols can be used alone or with the alcohol and/or amine to form the ester-amide mixtures. The amino alcohol can contain 1–20 carbon atoms, 1–6 hydroxy groups and 1–4 amine nitrogen atoms. Examples are ethanolamine, diethanolamine, N-ethanol-diethylene triamine, and trimethylol aminomethane.

Here again, the alkenyl group of the succinic esteramide can be hydrogenated or subjected to other reactions involving olefinic double bonds.

Representative examples of suitable ester-amide mixtures are referred to in U.S. Pat. Nos. 3,184,474; 3,576,743; 3,632,511; 3,804,763; 3,836,471; 3,862,981; 3,936,480; 3,948,800; 3,950,341; 3,957,854; 3,957,855; 3,991,098; 4,071,548; and 4,173,540.

Yet another sub-category of carboxylic derivative ashless dispersants which can be used comprises the Mannich-based derivatives of hydroxyaryl succinimides. Such compounds can be made by reacting a polyalkenyl succinic anhydride with an aminophenol to produce an N-(hydroxyaryl) hydrocarbyl succinimide which is then reacted with an alkylene diamine or polyalkylene polyamine and an aldehyde (e.g., formaldehyde), in a Mannich-base reaction. Details of such synthesis are set forth in U.S. Pat. No. 4,354,950. As in the case of the other carboxylic ashless dispersants discussed above, the alkenyl succinic anhydride or like acylating agent is derived from a polyolefin, preferably a polyisobutene, having a number average molecular weight of 500 to 5,000, preferably 700 to 2,500, more preferably 700 to 1,400, and especially 800 to 1,200. Likewise, residual unsaturation in the polyalkenyl substituent group can be used as a reaction site as for example, by hydrogenation, sulfurization, or the like.

Aminoguanidine products formed by reaction of an alkenyl succinic acylating agent and aminoguanidine or a basic salt thereof form still another sub-category of carboxylic derivative ashless dispersants. Among suitable dispersants of this type are those described in U.S. Pat. Nos. 4,908,145 and 5,080,815.

The term "ashless" as applied to the dispersants used in the preferred additive concentrates and lubricating oil compositions of this invention means that the dispersant is for all practical purposes devoid of any metal. Any metal therein is present in trace amounts carried over from processing used in making the dispersants or as impurities or contaminants. The dispersants thus may contain non-metal constituents such as sulfur and/or phosphorus. Thus the term "ashless" does not denote that the product will not leave some residues or deposits when exposed to high temperatures—rather, the term means that the product will not leave any significant amount of metal-containing residues or deposits when exposed to high temperatures.

Component c)

Hindered phenolic antioxidants such as a mixture of tertiary butyl phenols containing at least about 75% and preferably at least about 85% 2,6-di-tert-butylphenol, such as Ethyl® 735 antioxidant, constitute one preferred type of antioxidant for use in the compositions of this invention. Other suitable hindered phenolic antioxidants include 2,6-di-tert-butylphenol, 4-methyl-2,6-di-tert-butylphenol, 2,4,6-tri-tert-butylphenol, 2-tert-butylphenol, 2,6-diisopropylphenol, 2-methyl-6-tert-butylphenol, 2,4-dimethyl-6-tert-butylphenol, 4-(N,N-dimethylaminomethyl)- 2,6-di-tertbutylphenol, 4-ethyl-2,6-di-tert-butylphenol, 2-methyl-6-styrylphenol, 2,6-di-styryl-4-nonylphenol, and their analogs and homologs. Mixtures of two or more such mononuclear phenolic compounds are also suitable.

Also useful in the compositions of this invention are methylene-bridged alkylphenols, and these can be used singly or in combinations with each other, or in combinations with sterically-hindered unbridged phenolic compounds. Illustrative hindered methylene bridged compounds include 4,4'-methylenebis(6-tert-butyl-o-cresol), 4,4'-methylenebis(2-tert-amyl-o-cresol), 2,2'-methylene-bis(4-methyl-6-tert-butyl phenol), 4,4'-methylenebis(2,6-di-tert-butylphenol), and similar compounds. Also useful are mixtures of methylene-bridged alkylphenols such as are described in U.S. Pat. No. 3,211,652.

Oil-soluble secondary aromatic amine antioxidants which can be used in the compositions of this invention include such compounds as diphenylamine, alkyl diphenylamines containing 1 or 2 alkyl substituents each having up to about 16 carbon atoms, phenyl-α-naphthylamine, phenyl-β-naphthylamine, alkyl- or aralkyl- substituted phenyl-α-naphthylamine containing one or two alkyl or aralkyl groups each having up to about 16 carbon atoms, alkyl- or aralkyl-substituted phenyl-β-naphthylamine containing one or two alkyl or aralkyl groups each having up to about 16 carbon atoms, N,N'-dialkyl-o-phenylene diamines, N,N'-diatkyl-m-phenylene diamines, N,N'-dialkyl-p-phenylene diamines, 4-alkylaminodiphenylamines, and similar compounds. A preferred type of aromatic amine antioxidant is an alkylated diphenylamine of the general formula

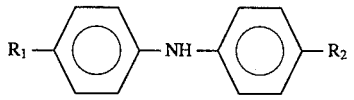

wherein $R_1$ is an alkyl group (preferably a branched alkyl group) having 8 to 12 carbon atoms, (more preferably 8 or 9 carbon atoms) and $R_2$ is a hydrogen atom or an alkyl group (preferably a branched alkyl group) having 8 to 12 carbon atoms, (more preferably 8 or 9 carbon atoms). Most preferably, $R_1$ and $R_2$ are the same. One such preferred compound is available commercially as Naugalube 438L, a material which is understood to be predominately a 4,4'-dinonyldiphenylamine (i.e., bis(4-nonylphenyl)amine) wherein the nonyl groups are branched.

It is preferable to use a combination of at least one oil-soluble hindered phenol antioxidant and at least one oil-soluble aromatic secondary amine antioxidant. When using such combinations, the proportions of the phenolic antioxidant to the aromatic amine antioxidant are preferably in the range of about 3–14 parts by weight of the phenolic antioxidant per part by weight of the amine antioxidant. Preferred proportions are in the range of about 4 to about 10 parts by weight, and more preferably about 4 to about 8 parts by weight, of the phenolic antioxidant per part by weight of the amine.

Component d)

Sulfurized fatty esters having a sulfur content in the range of 7 to 12 wt % are available as articles of commerce. These include such sulfurized fatty esters as SUL-PERM 10S, a product indicated by the manufacturer thereof, Keil Chemical Division of Ferro Corporation, to contain 9.5% sulfur and to have the following properties: a viscosity at 100° F. of 2000 SUS, a viscosity at 210° F. of 210 SUS, and a specific gravity at 77° F. of 0.9844; EP Oil GE-10, a product supplied by Hornett Brothers and indicated to have a sulfur content of 8.5 to 9.5 wt %, a flash point of 150° C., a viscosity at 100° C. of 30–40 cSt, a density of 0.97 g/mL at 15° C. and an acidity in the range of 5 to 9.5 mg KOH per gram.

Component e)

Various types of rust inhibitors are suitable for use in the compositions of this invention. These include dimer and trimer acids, such as are produced from tall oil fatty acids, oleic acid, linoleic acid, or the like. Products of this type are currently available from various commercial sources, such as, for example, the dimer and trimer acids sold under the HYSTRENE trademark by the Humco Chemical Division of Witco Chemical Corporation and under the EMPOL trademark by Emery Chemicals. Another useful type of rust inhibitor for use in the practice of this invention are the alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols. Other suitable corrosion inhibitors include ether amines; acid phosphates; amines; polyethoxylated compounds such as ethoxylated amines, ethoxylated phenols, and ethoxylated alcohols; imidazolines; modified imidazolines; and the like. Materials of these types are well known to those skilled in the art and a number of such materials are available as articles of commerce.

Component f)

Demulsifier(s) which can be used in the compositions of this invention can likewise be varied. These include oxyalkylated polyols, oxyalkylated phenol-formaldehyde condensation products, oxyalkylated polyamines, alkyl benzene sulfonates, polyethylene oxides, polypropylene oxides, block copolymers of ethylene oxide and propylene oxide, amine glycol condensates, salts and esters of oil soluble acids, and the like.

For example, use can be made of oxyalkylated trimethylol alkanes with molecular weights in the range of 1,000 to 10,000, and preferably in the range of 3,000 to 8,000. Preferably, the oxyalkylated trimethylol alkane is an oxyalkylated trimethylol ethane or propane, especially where the oxyalkylene groups are composed of a mixture of propyleneoxy and ethylenoxy groups and where these groups are so disposed as to form relatively hydrophobic blocks adjacent the trimethylol group and relatively hydrophilic blocks remote the trimethylol group. Typical oxyalkylated trimethylol propane demulsifiers are described in U.S. Pat. No. 3,101,374. Commercially available products of this type are available from BASF Corporation under the Pluradot trademark. They are available in various molecular weights. Pluradot HA-510 has an average molecular weight of 4,600 and Pluradot HA-530 has an average molecular weight of about 5,300. Pluradot additives are propoxylated and ethoxylated trimethylol propanes.

Another type of suitable demulsifers are oxyalkylated alkyl phenol-formaldehyde condensation products. Typically, these products have molecular weights in the range of about 4,000 to about 6,000 and are comprised of lower alkyl substituted phenol moieties joined together by methylene groups and in which the hydroxyl groups of the phenolic moieties have been ethoxylated. One such commercial product is marketed by Ceca S. A. of Paris, France under the "Prochinor GR77" trade name. The product is supplied as a concentrate in an aromatic solvent and the active ingredient is believed to be an ethoxylated nonylphenol-formaldehyde condensate of molecular weight 4,200 (by gel permeation chromatography calibrated with polystyrene).

Another suitable type of demulsifier is comprised of the tetra-polyoxyalkylene derivatives of ethylene diamine, especially the tetra-poly(oxyethylene)-poly(oxypropylene) derivatives of ethylene diamine. Materials of this type are available commercially from BASF Corporation under the "Tetronics" trademark. Materials of this general type are described in U.S. Pat. No. 2,979,528.

Mixtures of alkylaryl sulfonates, polyoxyalkylene glycols and oxyalkylated alkylphenolic resins, such as are available commercially from Petrolite Corporation under the TOLAD trademark, are also suitable. One such proprietary product, identified as TOLAD 286K, is understood to be a mixture of these components dissolved in a solvent composed of alkyl benzenes. TOLAD 286 is believed to be a similar product wherein the solvent is composed of a mixture of heavy aromatic naphtha and isopropyl alcohol.

Also useful as demulsifiers are proprietary materials available from BASF Corporation under the Pluronic and Pluradyne trademarks. These are believed to be block copolymers of propylene oxide and ethylene oxide.

Suitable amine glycol condensates are available under the TRITON trademark of Rohm & Haas Company. One such material of this type is TRITON CF-32 which is described by the manufacturer as composed of 95% active component(s) and 5% water which is a pale yellow liquid having a Brookfield viscosity at 25° C. of 550 cP, a specific gravity of 1.03 at 25° C., a density of 8.6 lb/gal, a pH (5% aqueous solution) of 9.5–11, a flash point (TOC) of <300° F., and a pour point of 15° F. (–9° C.).

Component g)

As noted above, component g) is preferably an oil of suitable lubricating viscosity, such as a light mineral oil. The diluent oils for this use are preferably mineral oils, such as 100 to 150 Solvent Neutral oils. However, synthetic oils such as hydrogenated polyalphaolefin oligomers, such as are formed from 1-decene of viscosities of up to about 10 centistokes at 100° C., are also useful. Other suitable diluents include low viscosity synthetic esters, polyols, and in general any inert liquid compatible with, and capable of dissolving suitable concentrations of, the components being utilized in the concentrate. Depending on the use to which the composition is to be put, still other additives can be employed therein. These include defoamants, pour point depressants, supplemental extreme pressure or antiwear additives, lubricity additives, friction modifiers, viscosity index improvers, and the like.

The following examples in which all parts are by weight, illustrate, but are not intended to limit, the invention.

EXAMPLE 1

A mixture is formed from 50 parts of (i) zinc di(2-ethylhexyl)dithiophosphate as a 90% solution in a diluent mineral oil, and 3.1 parts of (ii) zinc 2-ethylhexanoate. The resultant product is an 87% active solution containing 7.1 equivalents of (i) per equivalent of (ii). Typically the total base numbers of the resultant products made in this manner have fallen in the range of about 25.3 to 30.3 milligrams of KOH per gram using the ASTM D644 procedure.

EXAMPLE 2

Example 1 is repeated except that 50 parts of (i) and 3.5 parts of (ii) are used. The resultant product contains equivalents of (i) per equivalent of (ii).

EXAMPLE 3

Example 1 is repeated except that 50 parts of (i) and 2.64 parts of (ii) are used, thereby yielding a product containing 8 equivalents of (i) per equivalent of (ii).

EXAMPLES 4–6

The respective procedures of Examples 1–3 are repeated with the exception that in each case the diluent mineral oil is omitted, i.e., component (i) is used as undiluted zinc di(2-ethylhexyl)dithiophosphate.

EXAMPLES 7–9

The respective procedures of Examples 1–3 are repeated with the exception that in each case (i) and (ii) are mixed together in an added diluent consisting of 10 parts of 150 Solvent Neutral mineral oil.

EXAMPLES 10–18

Each of the respective procedures of Examples 1–9 is repeated, and in each case the product mixture is held at 50° C. for 15 minutes.

EXAMPLE 19

Example 1 is repeated substituting 35 parts of zinc di(2-ethylbutyl)dithiophosphate for the zinc di(2-ethylhexyl)dithiophosphate. The resultant product contains 6.5 equivalents of (i) per equivalent of (ii).

EXAMPLE 20

Example 1 is repeated except that the zinc di(2-ethylhexyl)dithiophosphate is replaced by 58 parts of zinc di(3-ethyl-2-pentyl)dithiophosphate. The resultant composition contains 8.0 equivalents of (i) per equivalent of (ii).

EXAMPLE 21

Example 1 is repeated substituting 4.05 parts of zinc 2-methylundecanoate for the zinc 2-ethylhexanoate whereby there is formed a composition containing 7.0 equivalents of (i) per equivalent of (ii).

EXAMPLE 22

Example 1 is repeated using 58 parts of zinc di(2-methylundecyl)dithiophosphate as (i) and 3.8 parts of zinc 2-methylundecanoate as (ii), which corresponds to 7.5 equivalents of (i) per equivalent of (ii).

EXAMPLE 23

Example 1 is repeated using 51.53 parts of zinc di(2-ethylbutyl)dithiophosphate as (i) and 4.2 parts of zinc 2-ethylbutanoate as (ii). The resultant product composition has 6.0 equivalents of (i) per equivalent of (ii).

EXAMPLE 24

An additive concentrate is formed by blending together the following components in the proportions specified: 54 parts of zinc product made as in Example 1, 19.05 parts of HiTEC® 4735 phenolic antioxidant (Ethyl Petroleum Additives Limited), 4.02 parts of Naugalube 438L alkylated diphenylamine antioxidant (Uniroyal Chemical Company), 6.47 parts of EP Oil GE-10 sulfurized ester (Hornett Brothers), 9.96 parts of HiTEC®536 rust inhibitor (Ethyl Petroleum Additives Limited), 0.5 part of HiTEC®646 succinimide ashless dispersant (Ethyl Petroleum Additives Limited), 0.56 Pluronics FL-11 demulsifier, and 5.44 parts of 150 Solvent Neutral mineral oil diluent.

EXAMPLE 25

An additive concentrate is formed by blending together the following components in the proportions specified: 53.1 parts of zinc product made as in Example 1, 16.19 parts of HiTEC® 4735 phenolic antioxidant (Ethyl Petroleum Additives Limited), 3.42 parts of Naugalube 438L alkylated diphenylamine antioxidant (Uniroyal Chemical Company), 5.50 parts of EP Oil GE-10 sulfurized ester (Hornett Brothers), 8.47 parts of HiTEC®536 rust inhibitor (Ethyl Petroleum Additives Limited), 0.43 part of HiTEC® 646 succinimide ashless dispersant (Ethyl Petroleum Additives Limited), 0.48 Pluronics FL-11 demulsifier, and 12.41 parts of 150 Solvent Neutral mineral oil diluent.

EXAMPLE 26

A hydraulic fluid composition is formed by blending 10 parts of concentrate made as in Example 24 with 990 parts of a mineral oil having a kinematic viscosity of 46 cSt ($mm^2s^{-1}$) at 40° C.

EXAMPLES 27–28

The procedure of Example 26 is repeated twice. The only differences are that in one case the mineral base oil has a kinematic viscosity of 32 cSt ($mm^2s^{-1}$) at 40° C., and in the other case the kinematic viscosity of the mineral base oil is 68 cSt ($mm^2s^{-1}$) at 40° C.

EXAMPLE 29

A hydraulic fluid composition is formed by blending 10 parts of concentrate made as in Example 25 with 990 parts of a mineral oil having a kinematic viscosity of 46 cSt ($mm^2s^{-1}$) at 40° C.

EXAMPLES 30–31

The procedure of Example 29 is repeated twice. The only differences are that in one case the mineral base oil has a kinematic viscosity of 32 cSt ($mm^2s^{-1}$) at 40° C., and in the other case the kinematic viscosity of the mineral base oil is 68 cSt ($mm^2s^{-1}$) at 40° C.

EXAMPLES 32–37

Examples 26 through 31 are repeated except that in each instance the amount of the additive concentrate made as in Example 24 or 25 (as the case may be) is 12 parts and the amount of the given base oil used is 988 parts.

The importance of the relative proportions of (i) to (ii) in the zinc product was demonstrated by multiple tests using the FZG extreme pressure test procedure (DIN test method DIN 51354). Identical lubricant compositions were formulated as in Example 26, so that each contained a product made from a mixture of zinc di(2-ethylhexyl)dithiophosphate and (ii) zinc 2-ethylhexanoate. The only difference was in the ratio of (i) di(2-ethylhexyl)dithiophosphate to (ii) zinc 2-ethylhexanoate used in making the zinc product. The product of this invention had a ratio of 7.1 equivalents of (i) per equivalent of (ii). In the product not of this invention the ratio was 4.9 equivalents of (i) per equivalent of (ii). It was found that the products of this invention typically successfully reached the level of 9 load-stages without failure, whereby failure occurred only at the tenth load stage. In sharp contrast, the product not of this invention typically passed only 6 load stages and failed at the seventh load stage.

The thermal stability performance of the compositions of this invention was demonstrated by use of the Cincinnati Milacron Thermal Stability Test Procedure "A" (see Cincinnati Milacron Lubricants Purchase Specification Approved Products Handbook, pages 3-1 to 3—3) and the ASTM D 2619 test procedure. In these tests an oil-based hydraulic fluid of this invention (designated Fluid A) formulated as in Example 26 except that it contained 4.85 wt % of zinc as a zinc product of this invention in which the di(2-ethylhexyl)dithiophosphate to zinc 2-ethylhexanoate ratio was 6.05:1. The comparative fully formulated hydraulic fluid product was identical except that it contained 4.05 wt % of zinc as di(2-ethylhexyl)dithiophosphate and no zinc carboxylate. This composition is designated as Fluid B. Results of the Cincinnati Milacron tests are summarized in Table 1. Appearance ratings are in terms of a scale of 1 to 10 in which the lower the numerical rating, the better the result.

TABLE 1

Cincinnati Milacron Test Results

| Property | Fluid A | Fluid B |
|---|---|---|
| Sludge, mg/100 mL | 1.03 | 5.44 |
| Copper Rod Rating | 2 | 10 |
| Copper Weight Loss, mg/100 mL | 0.1 | 0.6 |
| Steel Rod Rating | 1 | 1–2 |
| Steel Weight Loss, mg/100 mL | 0.08 | 0.09 |

The results from the ASTM D 2619 tests are summarized in Table 2, wherein TAN designates total acid number.

TABLE 2

ASTM D 2619 Test Results

| Property | Fluid A | Fluid B |
|---|---|---|
| Copper Weight Loss, $mg/cm^2$ | 0.16 | 0.21 |
| TAN of Water Layer, mg KOH/g | 0.85 | 0.77 |

Filterability performance of the compositions of this invention was demonstrated by use of the AFNOR wet and dry filtration procedures (French Standards NF E 48-691 and NF E 48-690, respectively, both dated December 1990). The composition of this invention, Fluid A described above, passed both procedures with values of 1.08 in both the wet and the dry filtration procedures. In our prior practice wherein the zinc component was di(2-ethylhexyl)dithiophosphate without zinc carboxylate, it had been deemed necessary to include a small amount of a calcium phenate detergent to the formulation in order to achieve passing thermal stability ratings. However this inevitably resulted in the composition failing the AFNOR wet test procedure even when the calcium detergent-containing composition was additionally formulated with all of the components of Example 24 (except that no zinc carboxylate was used).

The zinc additives of this invention can be used in a wide variety of lubricating oil compositions wherever extreme pressure properties are desired. Thus they can be used in automotive crankcase lubricating oils, automatic transmission fluids, gear oils, hydraulic oils, cutting oils, etc., in which the base oil of lubricating viscosity is a mineral oil, a synthetic oil, a natural oil such as a vegetable oil, or a mixture thereof, e.g. a mixture of a mineral oil and a synthetic oil. The preferred lubricating oil compositions of this invention are used as power transmission fluids, especially as hydraulic fluids.

Suitable mineral oils include those of appropriate viscosity refined from crude oil of any source including Gulf Coast, Midcontinent, Pennsylvania, California, Alaska, Middle East, North Sea and the like. Standard refinery operations may be used in processing the mineral oil. Among the general types of petroleum oils useful in the compositions of this invention are solvent neutrals, bright stocks, cylinder stocks, residual oils, hydrocracked base stocks, paraffin oils including pale oils, and solvent extracted naphthenic oils. Such oils and blends of them are produced by a number of conventional techniques which are widely known by those skilled in the art.

Among the suitable synthetic oils are homo- and interpolymers of $C_2$–$C_{12}$ olefins, carboxylic acid esters of both monoalcohols and polyols, polyethers, silicones, polyglycols, silicates, alkylated aromatics, carbonates, thiocarbonates, orthoformates, phosphates and phosphites, borates and halogenated hydrocarbons. Representative of such oils are homo- and interpolymers of $C_2$–$C_{12}$ monoolefinic hydrocarbons, alkylated benzenes (e.g., dodecyl benzenes, didodecyl benzenes, tetradecyl benzenes, dinonyl benzenes, di-(2-ethylhexyl)benzenes, wax-alkylated naphthalenes); and polyphenyls (e.g., biphenyls, terphenyls).

Alkylene oxide polymers and interpolymers and derivatives thereof where the terminal hydroxyl groups have been modified by esterification, etherification, etc., constitute another class of synthetic oils. These are exemplified by the oils prepared through polymerization of alkylene oxides such as ethylene oxide or propylene oxide, and the alkyl and aryl ethers of these polyoxyalkylene polymers (e.g., methyl polyisopropylene glycol ether having an average molecular weight of 1,000, diphenyl ether of polyethylene glycol having a molecular weight of 500–1,000, diethyl ether of polypropylene glycol having a molecular weight of 1,000–1,500) or mono- and poly-carboxylic esters thereof, for example, the acetic acid ester, mixed $C_3$–$C_6$ fatty acid esters, or the $C_{13}$ Oxo acid diester of tetraethylene glycol.

Another suitable class of synthetic oils comprises the esters of dicarboxylic acids (e.g., phthalic acid, succinic acid, maleic acid, azelaic acid, suberic acid, sebacic acid, fumaric acid, adipic acid, linoleic acid dimer) with a variety of alcohols (e.g., butyl alcohol, hexyl alcohol, dodecyl alcohol, 2-ethylhexyl alcohol, ethylene glycol). Specific examples of these esters include dibutyl adipate, di(2-ethylhexyl) adipate, didodecyl adipate, di(tridecyl) adipate, di(2-ethylhexyl) sebacate, dilauryl sebacate, di-n-hexyl fumarate, dioctyl sebacate, diisooctyl azelate, diisodecyl azelate, dioctyl phthalate, didecyl phthalate, di(eicosyl) sebacate, the 2-ethylhexyl diester of linoleic acid dimer, and the complex ester formed by reacting one mole of sebacic acid with two moles of tetraethylene glycol and two moles of 2-ethylhexanoic acid.

Other esters which may be used include those made from $C_3$–$C_{18}$ monocarboxylic acids and polyols and polyol ethers such as neopentyl glycol, trimethylolpropane, pentaerythritol and dipentaerythritol. Trimethylol propane tripelargonate, pentaerythritol tetracaproate, the ester formed from trimethylolpropane, caprylic acid and sebacic acid, and the polyesters derived from a $C_4$–$C_{14}$ dicarboxylic acid and one or more aliphatic dihydric $C_3$–$C_{12}$ alcohols such as derived from azelaic acid or sebacic acid and 2,2,4-trimethyl-1,6-hexanediol serve as examples.

Silicon-based oils such as the polyalkyl-, polyaryl-, polyalkoxy-, or polyaryloxy-siloxane oils and silicate oils comprise another class of synthetic lubricants (e.g., tetraethyl silicate, tetraisopropyl silicate, tetra-(2-ethylhexyl) silicate, tetra-(p-tert-butylphenyl) silicate, poly(methyl)siloxanes, and poly(methylphenyl)siloxanes. Other synthetic lubricating oils include liquid esters of phosphorus-containing acids (e.g., tricresyl phosphate, trioctyl phosphate, triphenyl phosphite, and diethyl ester of decane phosphonic acid.

Also useful as base oils or as components of base oils are hydrogenated or unhydrogenated liquid oligomers of $C_6$–$C_{16}$ α-olefins, such as hydrogenated or unhydrogenated oligomers formed from 1-decene. Methods for the production of such liquid oligomeric 1-alkene hydrocarbons are known and reported in the literature. See for example U.S. Pat. Nos. 3,749,560; 3,763,244; 3,780,128; 4,172,855; 4,218,330; 4,902,846; 4,906,798; 4,910,355; 4,911,758; 4,935,570; 4,950,822; 4,956,513; and 4,981,578. Additionally, hydrogenated 1-alkene oligomers of this type are available as articles of commerce. Blends of such materials can also be used in order to adjust the viscometrics of the given base oil. As is well known, hydrogenated oligomers of this type contain little, if any, residual ethylenic unsaturation. Preferred oligomers are formed by use of a Friedel- Crafts catalyst (especially boron trifluoride promoted with water or a $C_{1-20}$ alkanol) followed by catalytic hydrogenation of the oligomer so formed using procedures such as are described in the foregoing U.S. patents.

Other catalyst systems which can be used to form oligomers of 1-alkene hydrocarbons, which, on hydrogenation, provide suitable oleaginous liquids include Ziegler catalysts such as ethyl aluminum sesquichloride with titanium tetrachloride, aluminum alkyl catalysts, chromium oxide catalysts on silica or alumina supports and a system in which a boron trifluoride catalyst oligomerization is followed by treatment with an organic peroxide.

For some applications, for example use under conditions where oxidative or thermal degradation of the base oil is unlikely to be experienced, unhydrogenated 1-alkene oligomers can be used as the base oil or as a component in a base oil blend.

Likewise, various proprietary synthetic lubricants such as KETJENLUBE synthetic oil of Akzo Chemicals can be employed either as the sole base lubricant or as a component of the base lubricating oil.

Typical natural oils that may be used as base oils or as components of the base oils include castor oil, olive oil, peanut oil, rapeseed oil, corn oil, sesame oil, cottonseed oil, soybean oil, sunflower oil, safflower oil, hemp oil, linseed oil, tung oil, oiticica oil, jojoba oil, meadowfoam oil, and the like. Such oils may be partially or fully hydrogenated, if desired.

The fact that the base oils used in the compositions of this invention may be composed of (i) one or more mineral oils, (ii) one or more synthetic oils, (iii) one or more natural oils, or (iv) a blend of (i) and (ii), or (i) and (iii), or (ii) and (iii), or (i), (ii) and (iii) does not mean that these various types of oils are necessarily equivalents of each other. Certain types of base oils may be used in certain compositions for the specific properties they possess such as biodegradability, high temperature stability, non-flammability or lack of corrosivity towards specific metals (e.g. silver or cadmium). In other compositions, other types of base oils may be preferred for reasons of availability or low cost. Thus, the skilled artisan will recognize that while the various types of base oils discussed above may be used in the compositions of this invention, they are not necessarily functional equivalents of each other in every instance.

As used herein the term "oil-soluble" means that the substance under discussion should be sufficiently soluble at 20° C. in the base oil selected for use to reach at least the minimum concentration required to enable the substance to serve its intended function. Preferably the substance will have a substantially greater solubility in the base oil than this. However, the substance need not dissolve in the base oil in all proportions.

Each and every U.S. patent document referred to hereinabove is fully incorporated herein by reference.

I claim:

1. A zinc-containing additive formed by admixing (i) at least one zinc dialkyldithiophosphate wherein each alkyl group contains 6 to 12 carbon atoms and is branched on its beta-carbon atom, and (ii) at least one zinc alkanoate wherein each alkanoate group is branched on its beta-carbon atom, in a ratio of 6.0 to 8.0 equivalents of (i) per equivalent of (ii), said additive having a total base number of at least 10 milligrams of KOH per gram and a characteristic NMR peak in the range of 103 to 105 ppm.

2. An additive in accordance with claim 1 wherein each alkyl group of (i) has the same number of carbon atoms as each alkanoate group of (ii).

3. An additive in accordance with claim 1 wherein (i) is zinc di(2-ethylhexyl)dithiophosphate and (ii) is zinc 2-ethylhexanoate.

4. An additive in accordance with claim 3 wherein the ratio of (i) to (ii) is in the range of 6.5 to 7.2 equivalents of (i) per equivalent of (ii).

5. An additive in accordance with claim 1 wherein the ratio of (i) to (ii) is in the range of 6.5 to 7.2 equivalents of (i) per equivalent of (ii).

6. An additive in accordance with claim 4 wherein the ratio is in the range of 6.9 to 7.1 equivalents of (i) per equivalent of (ii).

7. An additive in accordance with claim 5 wherein the ratio is in the range of 6.9 to 7.1 equivalents of (i) per equivalent of (ii).

8. A lubricant composition which comprises oil of lubricating viscosity and an additive in accordance with claim 1.

9. A lubricant composition which comprises oil of lubricating viscosity and an additive in accordance with claim 4.

10. A lubricant composition which comprises oil of lubricating viscosity and an additive in accordance with claim 5.

11. A lubricant composition in accordance with claim 8 further comprising an oil-soluble ashless dispersant wherein the ashless dispersant is a carboxylic derivative ashless dispersant, and wherein the lubricant composition further comprises an antioxidant, a sulfurized fatty ester having a sulfur content in the range of 7 to 12 wt %, a rust inhibitor, and a demusifier.

12. A lubricant composition in accordance with claim 9 further comprising an oil-soluble ashless dispersant wherein the ashless dispersant is a carboxylic derivative ashless dispersant, and wherein the lubricant composition further comprises an antioxidant, a sulfurized fatty ester having a sulfur content in the range of 7 to 12 wt %, a rust inhibitor, and a demusifier.

13. A lubricant composition in accordance with claim 10 further comprising an oil-soluble ashless dispersant wherein the ashless dispersant is a carboxylic derivative ashless dispersant, and wherein the lubricant composition further comprises an antioxidant, a sulfurized fatty ester having a sulfur content in the range of 7 to 12 wt %, a rust inhibitor, and a demusifier.

14. An additive concentrate which comprises a) an additive in accordance with claim 1 and b) an oil-soluble ashless dispersant.

15. An additive concentrate which comprises a) an additive in accordance with claim 4 and b) an oil-soluble ashless dispersant.

16. An additive concentrate which comprises a) an additive in accordance with claim 5 and b) an oil-soluble ashless dispersant.

17. An additive concentrate in accordance with claim 14 wherein the ashless dispersant is a carboxylic derivative ashless dispersant, and wherein the concentrate further comprises c) an antioxidant, d) a sulfurized fatty ester having a sulfur content in the range of 7 to 12 wt %, e) a rust inhibitor, and f) a demusifier.

18. An additive concentrate in accordance with claim 15 wherein the ashless dispersant is a carboxylic derivative ashless dispersant, and wherein the concentrate further comprises c) an antioxidant, d) a sulfurized fatty ester having a sulfur content in the range of 7 to 12 wt %, e) a rust inhibitor, and f) a demusifier.

19. An additive concentrate in accordance with claim 16 wherein the ashless dispersant is a carboxylic derivative ashless dispersant, and wherein the concentrate further comprises c) an antioxidant, d) a sulfurized fatty ester having a sulfur content in the range of 7 to 12 wt %, e) a rust inhibitor, and f) a demusifier.

* * * * *